US008836592B2

(12) United States Patent
Paulus et al.

(10) Patent No.: US 8,836,592 B2
(45) Date of Patent: Sep. 16, 2014

(54) VEHICLE GLAZING WITH SLOT ANTENNA

(75) Inventors: Peter Paulus, Muenster (DE); Stephen Roland Day, Wigan (GB)

(73) Assignees: Pilkington Automotive Deutschland GmbH, Witten (DE); Pilkington Group Limited, St. Helens, Merseyside (GB)

( * ) Notice: Subject to any disclaimer, the term of this patent is extended or adjusted under 35 U.S.C. 154(b) by 274 days.

(21) Appl. No.: 13/514,957

(22) PCT Filed: Dec. 21, 2010

(86) PCT No.: PCT/GB2010/052178

§ 371 (c)(1),
(2), (4) Date: Jun. 8, 2012

(87) PCT Pub. No.: WO2011/077142

PCT Pub. Date: Jun. 30, 2011

(65) Prior Publication Data

US 2012/0256798 A1 Oct. 11, 2012

(30) Foreign Application Priority Data

Dec. 21, 2009 (GB) ..... 0922191.2

(51) Int. Cl.
*H01Q 1/32* (2006.01)

(52) U.S. Cl.
USPC ..... 343/713; 343/767

(58) Field of Classification Search
CPC . H01Q 1/1271; H01Q 1/1278; H01Q 1/3275; H01Q 1/3291
USPC ..... 343/711, 713, 767
See application file for complete search history.

(56) References Cited

U.S. PATENT DOCUMENTS

| | | | | |
|---|---|---|---|---|
| 5,012,255 | A | 4/1991 | Becker | |
| 5,867,129 | A | 2/1999 | Sauer | |
| 5,898,407 | A | 4/1999 | Paulus et al. | |
| 8,466,842 | B2 * | 6/2013 | Dai | 343/713 |
| 2003/0232197 | A1 | 12/2003 | Disteldorf | |
| 2005/0007284 | A1 * | 1/2005 | Komatsu et al. | 343/713 |
| 2005/0035913 | A1 * | 2/2005 | Baranski | 343/713 |
| 2005/0128153 | A1 | 6/2005 | Doi et al. | |

(Continued)

FOREIGN PATENT DOCUMENTS

| | | | |
|---|---|---|---|
| EP | 0 561 272 | A1 | 9/1993 |
| EP | 1 530 253 | A1 | 5/2005 |

(Continued)

OTHER PUBLICATIONS

Search Report dated Jun. 1, 2010, issued by the United Kingdom Patent Office in corresponding United Kingdom Patent Application No. 0922191.2. (1 page).

(Continued)

*Primary Examiner* — Tan Ho
(74) *Attorney, Agent, or Firm* — Buchanan Ingersoll & Rooney PC

(57) ABSTRACT

Laminated vehicle glazing with a conductive panel defining slot antennas between the conductive panel and the metal surround of the vehicle with connecting leads, and a camera or other device in an area where the device and the antenna do not overlap. Locating the device in a different position to the slot antenna reduces the electromagnetic interference that the slot antenna experiences and prevents malfunction of the device where the slot antenna is used to transmit radio signals.

21 Claims, 10 Drawing Sheets

(56) References Cited

U.S. PATENT DOCUMENTS

Figure 1:
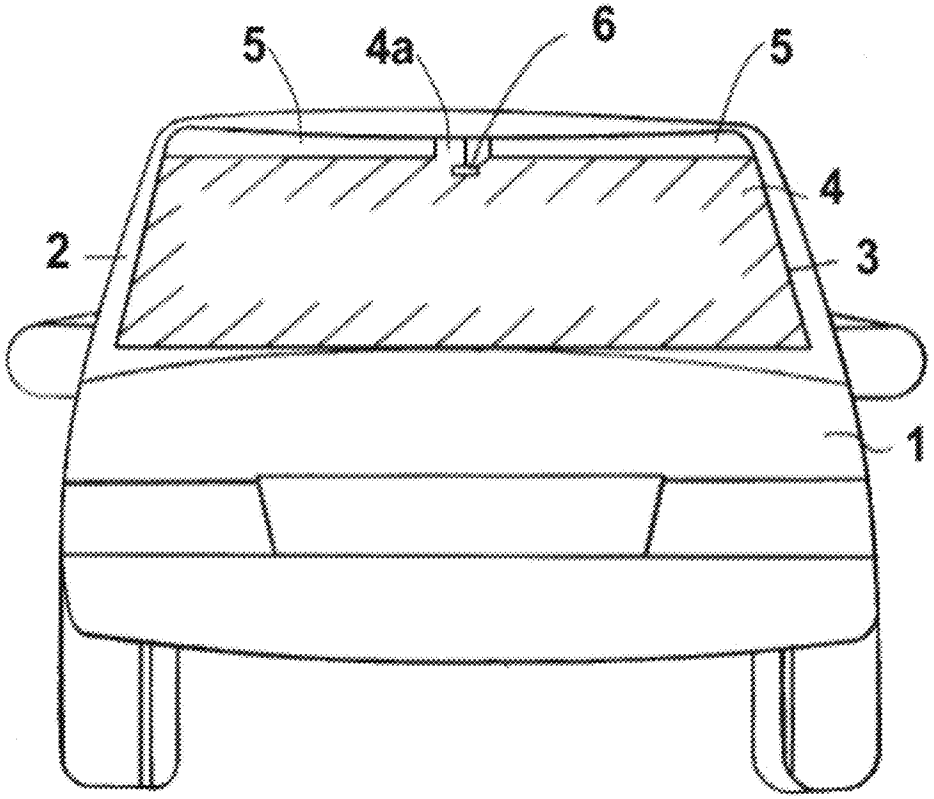

| | | | |
|---|---|---|---|
| 2006/0139223 | A1 | 6/2006 | Li et al. |
| 2006/0202898 | A1 | 9/2006 | Li et al. |
| 2006/0250711 | A1 | 11/2006 | Noguchi et al. |

FOREIGN PATENT DOCUMENTS

| | | | |
|---|---|---|---|
| JP | 03-204202 | A | 9/1991 |
| WO | 03/028151 | A1 | 4/2003 |
| WO | 2005/091827 | A2 | 10/2005 |

OTHER PUBLICATIONS

International Search Report (PCT/ISA/210) issued on May 24, 2011, by the European Patent Office as the International Searching Authority for International Application No. PCT/GB2010/052178.

* cited by examiner

VEHICLE GLAZING WITH SLOT ANTENNA

The present invention relates to a laminated vehicle glazing having at least one slot antenna and at least one device that can emit electromagnetic radiation incorporated therein, and vehicles comprising said glazing.

Modern automotive vehicle glazings having at least one antenna must satisfy the extreme requirements for the reception and transmission of electromagnetic waves and, indeed are required to act as broad-band antennas, i.e. antennas which are effective over a wide frequency range for electromagnetic waves of different polarizations. Further, there is a need in modern automotive glazing to incorporate multiple antennas for diversity applications and multiple services. The high requirements pertain not only to reception/transmission levels but also to the geometry of the radiation or reception characteristics.

Typical frequency ranges include the usual AM range for long wave, medium wave and shortwave (150 kHz-30 MHz), the VHF range for radio and television reception (30 MHz to 300 MHz) and the UHF range for television reception, for mobile radio and for satellite communication (global positioning satellite, GPS or the like), and remote control devices (300 MHz-2 GHz).

In practice, antenna glazings for automotive vehicles have commonly used antenna elements which have the configuration of wires or are conductors which are screen-printed on a glass pane or embedded into the interlayer.

It is desirable to produce laminated vehicle glazings with solar control and/or heating characteristics, which can be achieved using an electrically conductive panel which may be a coating or a wire arrangement. Such a conductive panel may be arranged in a glazing with a peripheral spacing from the edge of the glazing and thus from the metallic body of a vehicle, defining a slot region. As a result the conductive panel is electromagnetically decoupled significantly from the body of the vehicle.

It is known that such a slot can be used as an antenna. The feed to the antenna glazing and the coupling of radio waves from the latter is effected with the aid of connecting means, e.g. coaxial cables. Research has shown that the transmission and reception characteristics from an energy point of view as well as from the directional characteristic point of view can be improved by carefully designing the slot geometry and the feeding geometry. This is especially the case when the antenna pane must be satisfactory for transmission and reception in a broad-band range.

The electrically conductive coating may be a solar control coating which in the context of the present invention is intended to refer to all electrically-conductive coatings which can reduce solar energy transmission in at least a partial region of the solar spectrum. Usually the reduction is in the visible and infrared ranges. The aforementioned solar control coatings are normally applied over the entire window area except for a small boundary at the glass edge which is kept coating-free for anti-corrosion reasons.

For vehicles which have windows with such solar control coatings, it has been difficult, if not impossible, to provide antenna windows with good reception and/or transmission quality over a broad band, without noticeable detriment to the solar control effectiveness or damage to the optical characteristics. A solution to this problem is disclosed in U.S. Pat. No. 5,898,407 which describes an antenna pane comprising an inner pane, an outer pane, a bonding layer between the two panes securing them both together and an optically-transparent electrically-conductive solar control coating which can be on a foil disposed in the bonding layer or a layer system applied to one of the inner surfaces of the glass pane. In the region of at least one edge of the antenna window, the solar control coating is set back from and defines with a corresponding edge of the window opening, a strip-like slot region, generally greater than 15 mm wide. At least on one of the edges of the antenna window, the solar control coating runs to near to the edge of the antenna pane and overlaps the corresponding edge region of the window opening.

Because of the overlapping of an edge region of the window opening and the solar control coating, a high-frequency conducting path is formed between the solar control coating and the metallic vehicle body. The slot region between the solar control coating and the corresponding edge of the window opening serves as a slot antenna in the vehicle body. Slot antennas, also known as slot radiators, are known in high-frequency technology, and are most useful where it can be arranged that the slot length is in the region of a quarter to two wavelengths.

Slot antennas are characterized by a slot of a given length and width in a conducting plane or in a shield which surrounds this slot and can be utilized or excited, either as a receiving antenna or a transmission antenna. The magnetic field of a slot antenna corresponds, for example, to the electrical field of a conventional dipole antenna of corresponding length. The electric field of the slot antenna corresponds to the magnetic field of a dipole.

However, a problem exists when automotive glazings have antennas present alongside devices that can emit electromagnetic radiation. Such devices are fitted to the glass and include cameras and sensors, for example onboard units for tolling, or any other device, which emits—wanted or unwanted—electromagnetic radiation. It is known that in normal antenna glazings (without conductive coatings) the antenna conductors avoid the above mentioned devices, ideally by 5 cm to 15 cm, to minimize the coupling for interfering signals into the antenna conductor.

In the case of conductive coatings, especially solar control coatings in windscreens, one cannot afford such wide uncoated areas for functional and aesthetic reasons. Therefore the devices can induce voltages and currents in the coating, and thereby electromagnetic interference (EMI) will adversely affect the electrical and magnetic fields of any slot antennas present. Radio receivers are very sensitive to EMI since they often function by picking up signals comprising merely nano-watts of power from the air. Therefore, a need exists for a vehicle glazing having at least one slot antenna and at least one device that can emit electromagnetic radiation incorporated therein that avoids the drawbacks associated with current glazings wherein EMI is generated by such devices.

According to a first aspect of the present invention, there is provided a laminated vehicle glazing for fitting within a metal surround, said glazing comprising:

an inner pane, an outer pane, a bonding layer between said inner pane and said outer pane, a conductive panel arranged to define at least one elongated dielectric slot antenna between an edge of the metal surround and an edge of the conductive panel, said at least one slot antenna comprising a high-frequency current-conductive frame bounding an elongated area of the antenna and opposed edge conductors adapted for the connection of connecting leads, and at least one device that can emit electromagnetic radiation, wherein said device occupies an area, wherein the area of the at least one device that can emit electromagnetic radiation and the area of the at least one slot antenna do not overlap in the projection of said areas on the plane of the outer pane.

It is to be understood that in the context of the present invention the area of each slot antenna and the area of each device are defined as the areas of each slot antenna and each device when said each slot antenna and each device are viewed perpendicular to the plane of the outer pane.

This arrangement is advantageous because it reduces the EMI that the at least one slot antenna experiences by locating the at least one device in a different position to the at least one slot antenna. Ordinarily, when a slot antenna is used to transmit radio signals, transmitted powers can be several watts and therefore a device can be susceptible to malfunction. However, the invention described herein also has the reverse benefit of preventing malfunction of the device where the slot antenna is used to transmit radio signals. It can be said that the invention improves electromagnetic compatibility (EMC).

The at least one device may be located in a region between longitudinal ends of the at least one slot antenna in the projection of said areas on the plane of the outer pane. This arrangement is advantageous because the at least one device restricts the view through the glazing as little as possible and, if the device requires cabling to provide power, such an arrangement reduces the amount of cabling required. Any cabling passing across the slot to the device is easily able to induce voltages across the slot and hence EMI. Furthermore, the grounding or suppression of radiation is best achieved with a conductive panel of high conductivity in proximity to the device that in turn has good conductance to the adjacent frame. Since in practice the conductive panel used may have limited conductance it is advantageous to 1) locate the at least one device near to the metal surround which may be highly conductive, such as a car body and/or 2) provide additional conductive means like silver prints.

In some embodiments a radiating/receiving area of the at least one device and a receiving/radiating area of the at least one slot antenna do not overlap in the projection of said areas on the plane of the outer pane. It is to be understood that in the context of the present invention the receiving/radiating area of each slot antenna and the radiating/receiving area of each device are defined as the areas of each slot antenna and each device and any associated connecting leads where electromagnetic radiation can be radiated or received, when said each slot antenna and each device are viewed perpendicular to the plane of the outer pane.

The conductive panel may be arranged to overlap with the metal surround in at least one edge region of the glazing, thereby being high-frequency current coupled to said metal surround at said at least one edge region. It is to be understood that in this context "overlap" means that the conductive panel and metal surround overlap in the projection of the areas of the conductive panel and metal surround on the plane of the outer pane. For instance, the conductive panel may be arranged to overlap with the metal surround in two, three, four or more edge regions of the glazing.

Where the conductive panel is arranged to overlap with the metal surround in at least one edge region of the glazing, the at least one device may be located in said at least one edge region. Grounding or suppression of EMI generated by the at least one device can be improved by locating the at least one device in such a region.

The glazing may further comprise means for separating the electrical current around at least one longitudinal end of said at least one slot antenna from the electrical current induced by said at least one device. Such an arrangement further reduces the EMI that the at least one slot antenna experiences by separating interfering currents.

Said means may comprise at least one conductive wire and/or at least one conductive print electrically connected or capacitively coupled to the conductive panel.

Said at least one conductive wire and/or at least one conductive print may be located at one or more longitudinal end of the at least one slot antenna. In such embodiments, said wire and/or print may extend across a portion of the conductive panel and be grounded, for example to the metal surround.

Alternatively, or additionally, the at least one conductive wire and/or at least one conductive print may be located such that said wire and/or print at least partially encloses the at least one device.

The at least one conductive wire and/or at least one conductive print may be manufactured from any suitable substance such as one or more of silver, copper, gold or aluminium.

The at least one conductive wire and/or at least one conductive print may be capable of emitting heat. Such wire and/or print can be useful for heating in order to defrost and/or demist the glazing and/or to provide heat to the at least one device.

The means for separating a flow of electrical current at at least one longitudinal end of said at least one slot antenna from electrical currents induced by said at least one device may, alternatively, comprise at least one barrier line for electrically isolating regions of the conductive panel. Said at least one barrier line may comprise a gap in the conductive panel. It goes without saying that particularly when barrier lines are provided for in the vision area of the glazing, their width should be kept as narrow as possible. The lower limit of the line width here is determined by the need to prevent short circuiting between adjacent segments to prevent impairment of the antenna function and undesirable current flows. A barrier line width of about 0.05-0.1 mm has proved effective in practice.

The at least one barrier line may be straight or angled, undulating, curved, zigzagged, fractal and/or other non-rectilinear barrier lines. The at least one barrier line may form a grid of constant or variable raster unit size.

The at least one barrier line may be generated by means of laser technology. Here the conductive panel can be treated at various stages of production of the glazing. YAG lasers have proved particularly effective. Local (electro)chemical processing, electroerosion or maskings are also suitable for generating the barrier lines, but these are normally more expensive and less versatile.

The at least one device may be a camera, such as a night vision camera and/or a multi-purpose camera, and/or a sensor, such as a rain sensor, a toll sensor, a garage door opener, a temperature and humidity sensor, and/or a solar radiation sensor for air conditioning control. The at least one device may be located in any suitable position such as attached to an inner surface of said inner pane or an outer surface of said outer pane.

The conductive panel may comprise an optically transparent solar control coating capable of reducing solar energy transmission in at least one portion of the solar energy spectrum. The coating may be a coating of one or more noble metal or semiconductive metal oxide. The solar control coating may be applied directly upon one or more of the panes or may be provided on a thin transparent foil, for example, of polyethyleneterephthalate (PET) which may be bonded with bonding layers to the panes, especially between the latter.

The transparent foil can be comprised of a first foil, for example PET, which carries the electrically conductive, especially metallic, solar control coating layer, adjacent a second transparent foil. The foil(s) with the solar control coating can be cut shorter than the bonding layers so that the solar control coating terminates at a spacing from a corresponding edge of the metal surround to define therewith the at least one slot antenna. The bonding layers are of the usual material utilized in safety glass. Typical bonding layers are composed of polyvinylbutyral (PVB) or EVA.

The conductive panel may be capable of heating, defrosting and/or demisting the glazing. Electrical heating current applied to the conductive panel will preferably not cross the projection of the slot antenna, unless a) measures have been taken to prevent antenna frequency current flowing in the heater current connection, or b) electronic circuit design techniques have been used to combine the functionality of the heater current supply and a radio antenna connection across the slot.

The conductive panel may comprise an arrangement of conductive wires. It is to be understood that in the context of this invention wire heating fields, from a high frequency point of view, can act in a similar way as a conductive coating. However, more constraints may be necessary on how connectors such as busbars supplying current to the wires are arranged to maintain a consistent heating function in all parts of the glazing.

The glazing may comprise at least two slot antennas being arranged parallel and adjacent to one another over at least a part of their length. This arrangement allows for better use to be made of the limited space between the conductive panel and the border of the glazing, enabling further antenna systems of differing frequency ranges to be accommodated without substantially impairing the function of the slot antennas.

The conductive panel may have one or more cut out area where the conductive panel is not present. Said cut out area may partially overlap with the area of the at least one device. Such an arrangement is of benefit when using certain devices such as night vision cameras and rain sensors in order that the functionality of the device is not adversely affected by the conductive panel.

The conductive panel may be provided at any optional location between an inner surface of the outer glass pane and an inner surface of the inner pane. The conductive panel may be a glass coating or a coated foil. The conductive panel may have a resistance per unit area of 2 ohms per square to significantly less than 100 ohms per square.

The slot antenna in its simplest form, may be provided at only one edge region of the glazing, for instance at an upper edge. The at least one slot antenna may be any suitable shape such as an elongate length, L-shape or U-shape.

From a fabrication point of view, it has been found to be advantageous to form the at least one slot antenna across the entire length of an edge of a pane along which said slot antenna is provided. However, the length of the slot antenna can be shorter than that of an edge of the glazing. While the slot region may be symmetrical with respect to the centre of the glazing, it may also be asymmetrical with respect to the centre of the glazing.

At least one conductive strip can be provided that follows at least a portion of at least one edge of the conductive panel. Such strips can be beneficial in reducing ohmic losses from currents flowing around the slot antenna. The strips can protrude from the edge of the glass to form low impedance paths to the window surround.

The aesthetic appearance of the slots antennas can be improved if the at least one slot antenna is covered by an electrically-nonconducting opaque printed strip or the like. Alternatively a tinted foil can be bonded to the glazing that functions as a sunshade.

The at least one slot antenna can extend from one lateral edge of the glazing to the other, i.e. all along a respective side of the latter and can have different spacings from the metallic surround framing the window opening.

Along the at least one slot antenna, a plurality of coupling elements can be provided for coupling radio frequency waves to/from the slot antenna. The glazing can form part of a diversity system and can be connected to a diversity circuit.

Slot antennas can be coupled via connecting leads such as coaxial cable for the feeding of high-frequency energy to the slot antenna or from the slot antenna to receiving/transmitting circuitry with inner or core conductor and outer or shield conductor connected/coupled at opposite sides of the slot.

The coupling element can be a flat electrode disposed along the edge of the slot antenna to overlap the conductive panel and thereby capacitively couple to the slot antenna.

Directly adjoining or proximal to the coupling location, an amplifier which is grounded to the metal surround can be provided. The coupling element can cross the slot antenna. Furthermore, the coupling element can include one or more strip-like or linear conductors running to or from the conductive panel.

Depending upon the frequency and vehicle dimensions, the glazing can be provided with a single coupling element, preferably located at the longitudinal centre of the at least one slot antenna. The glazing can, however, have two or more coupling devices which are spaced apart along the at least one slot antenna. The slot geometry and location or locations of the coupling or couplings serve to determine the sending and transmitting properties and the spatial sending and transmission characteristics. With a capacitive feed the dimensioning of the coupling element's area enables some radio frequency impedance matching.

According to another aspect of the present invention there is provided a vehicle incorporating at least one glazing in accordance with the first aspect.

It will be appreciated that optional features applicable to one aspect of the invention can be used in any combination, and in any number. Moreover, they can also be used with any of the other aspects of the invention in any combination and in any number. This includes, but is not limited to, the dependent claims from any claim being used as dependent claims for any other claim 1n the claims of this application.

Figure 2:
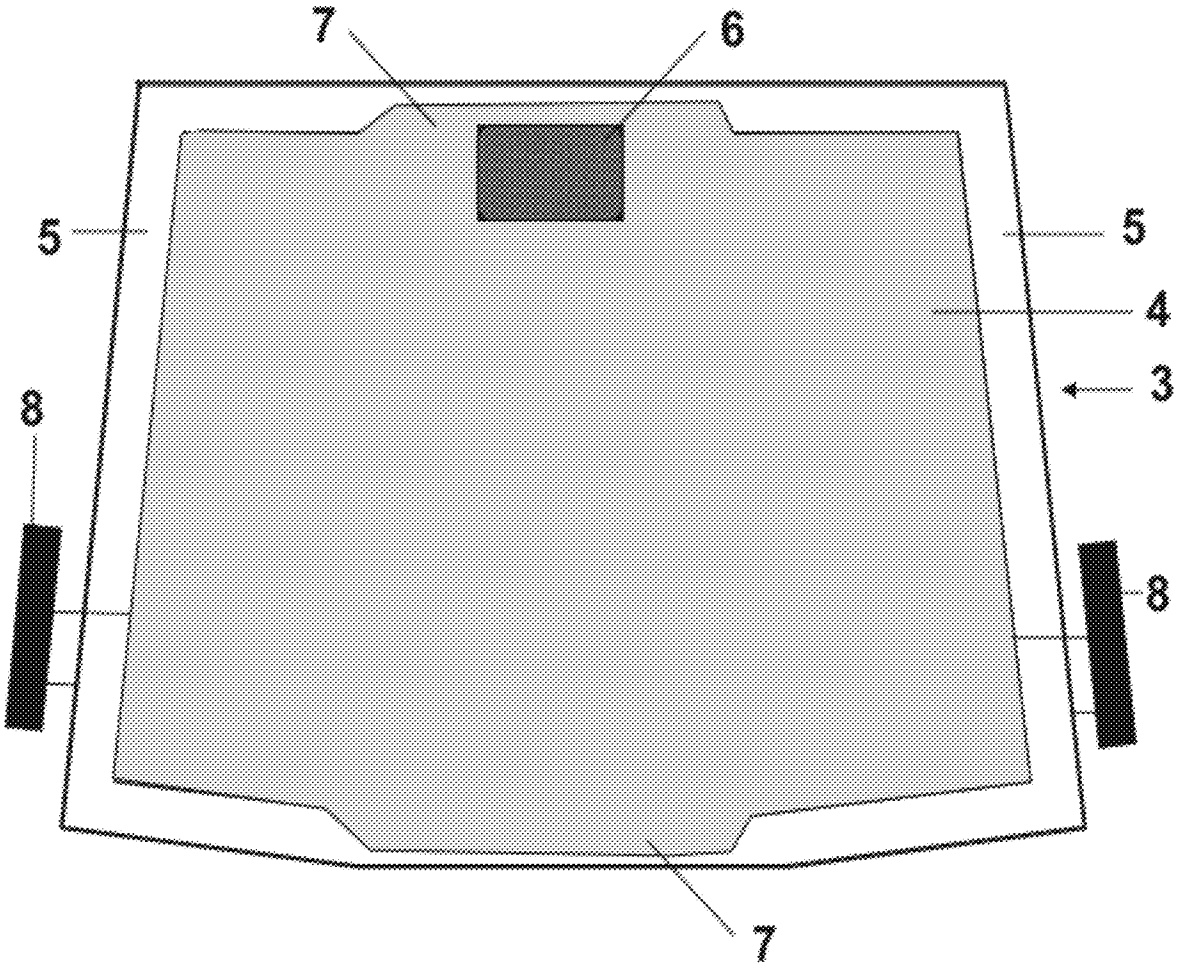
Figure 3:
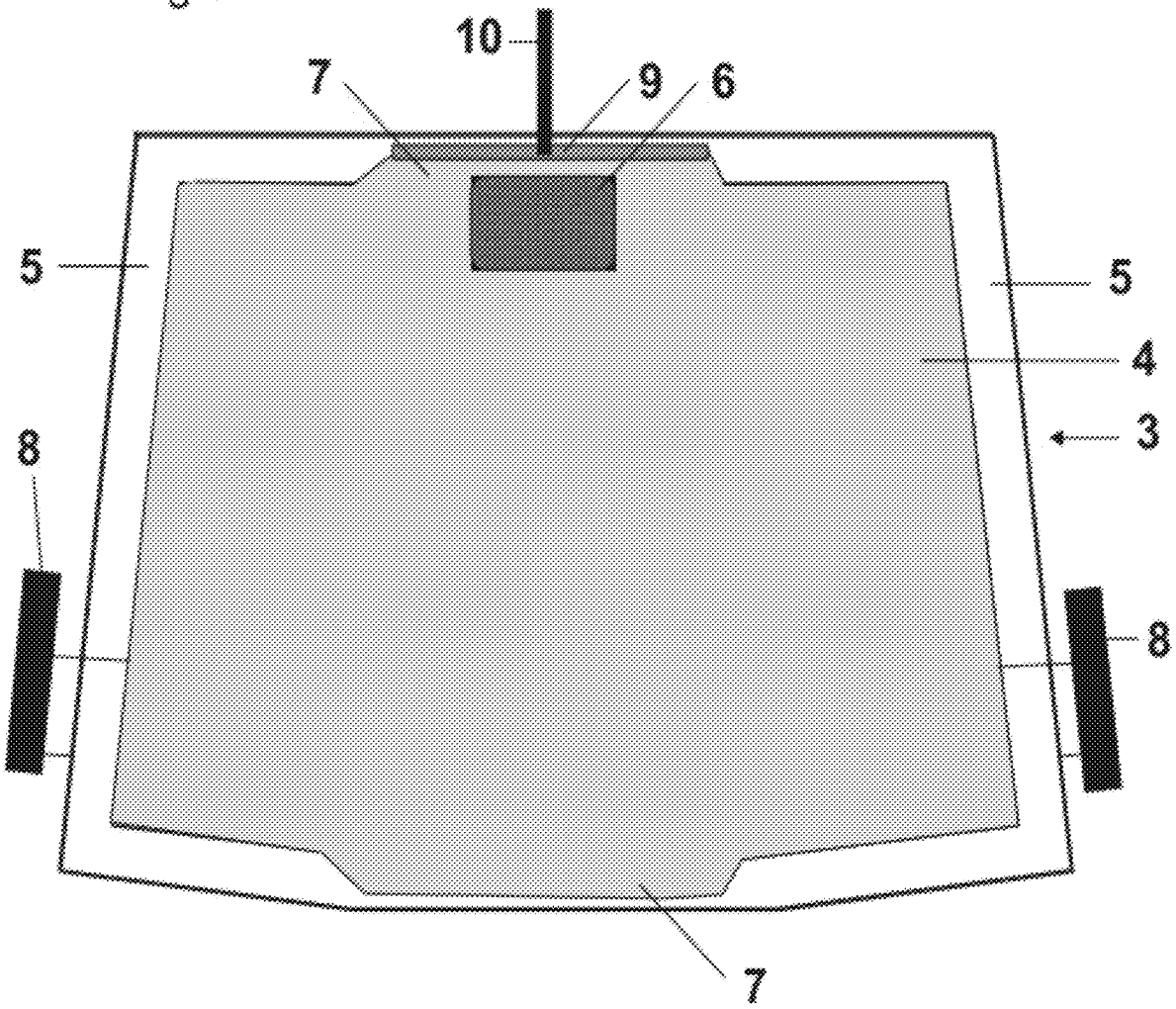
Figure 4:
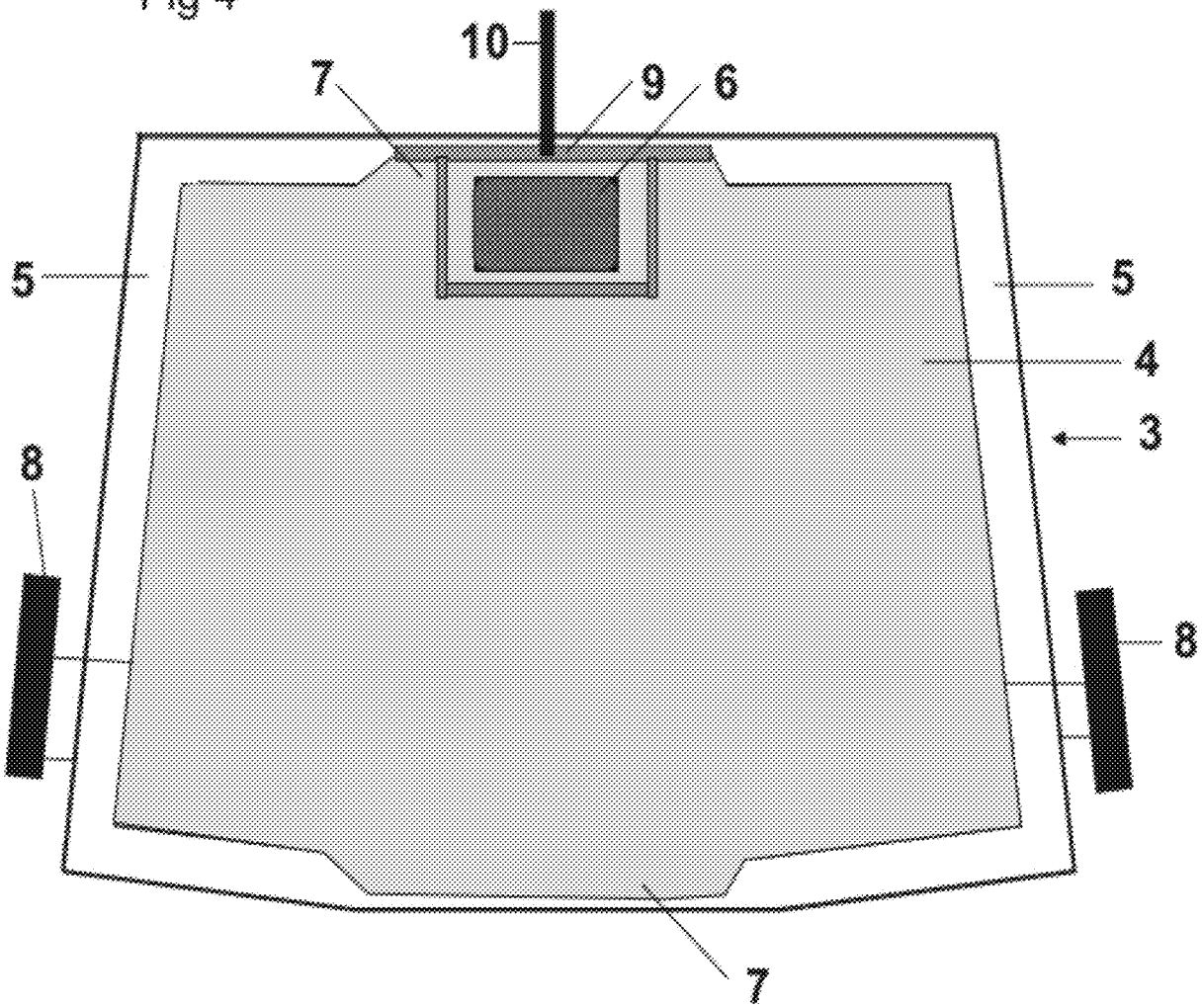
Figure 5:
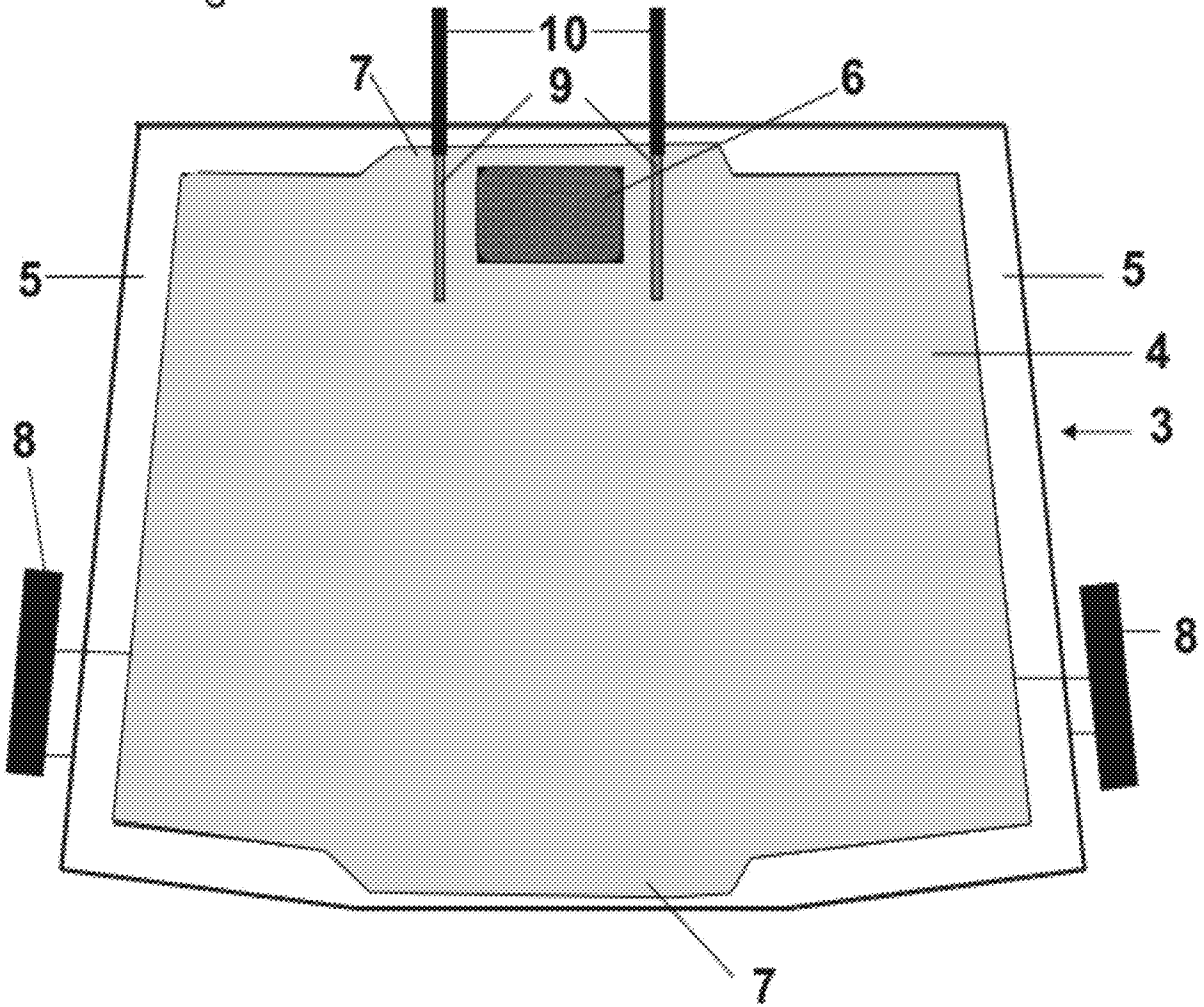
Figure 6:
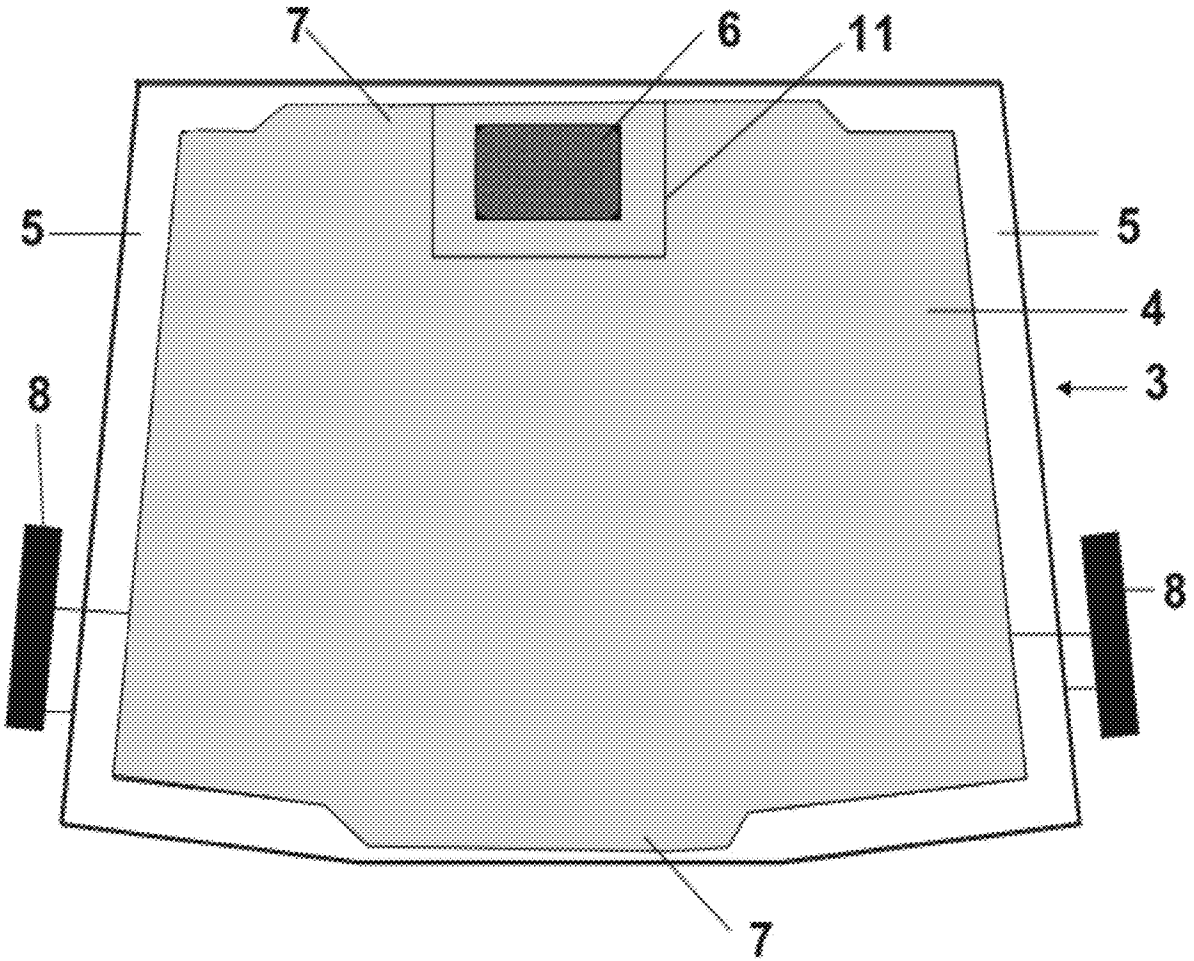
Figure 7:
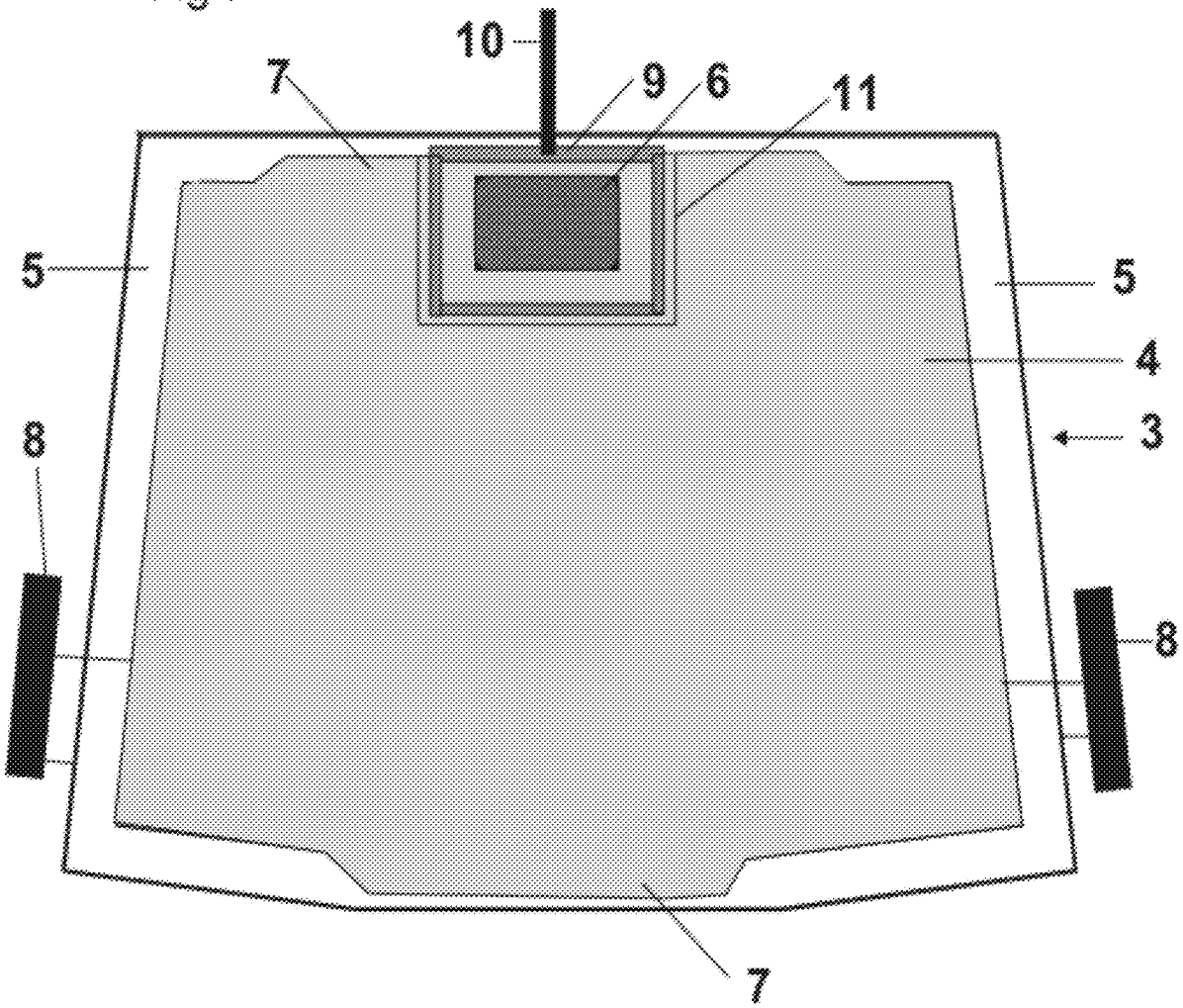
Figure 8:
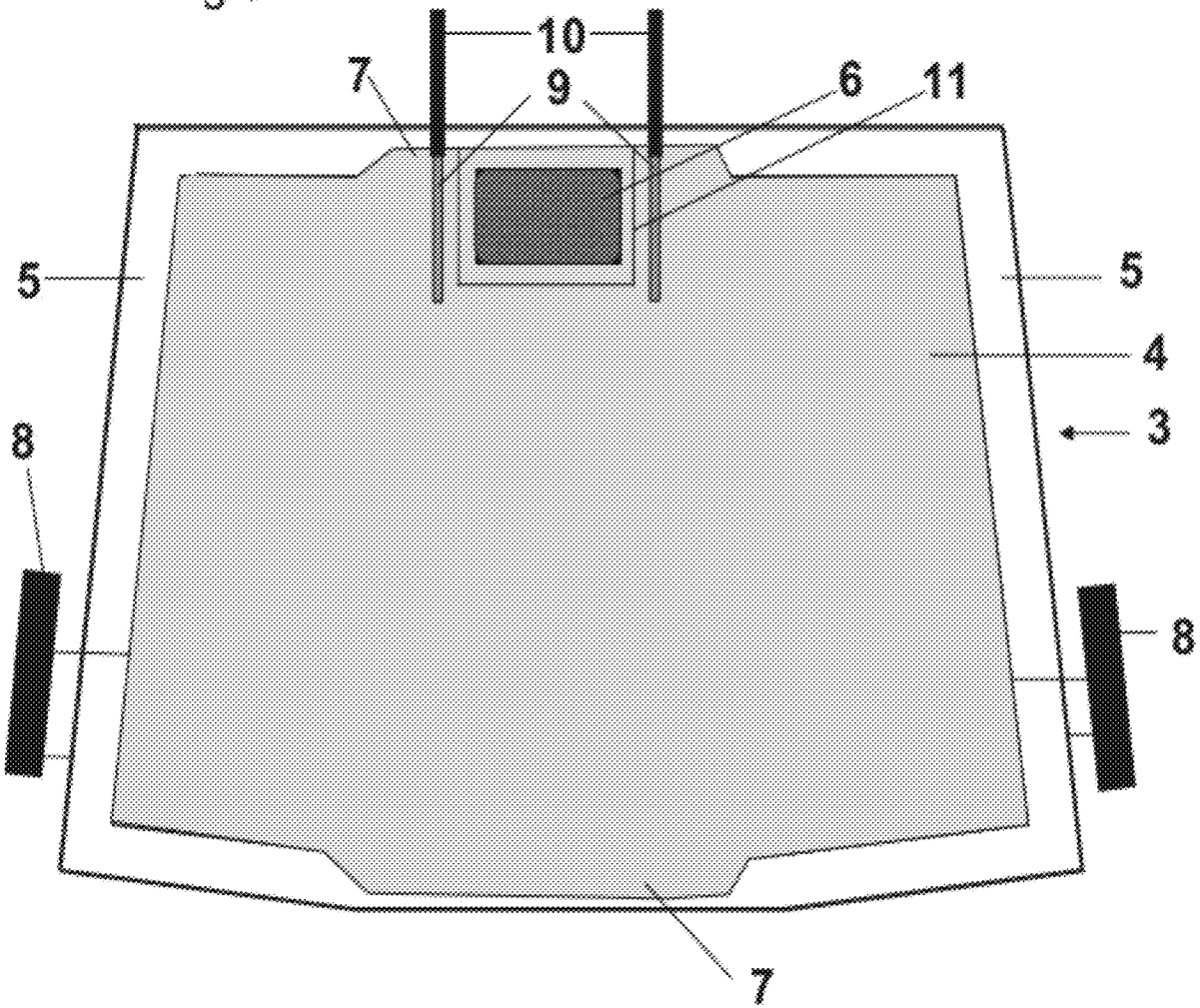
Figure 9:
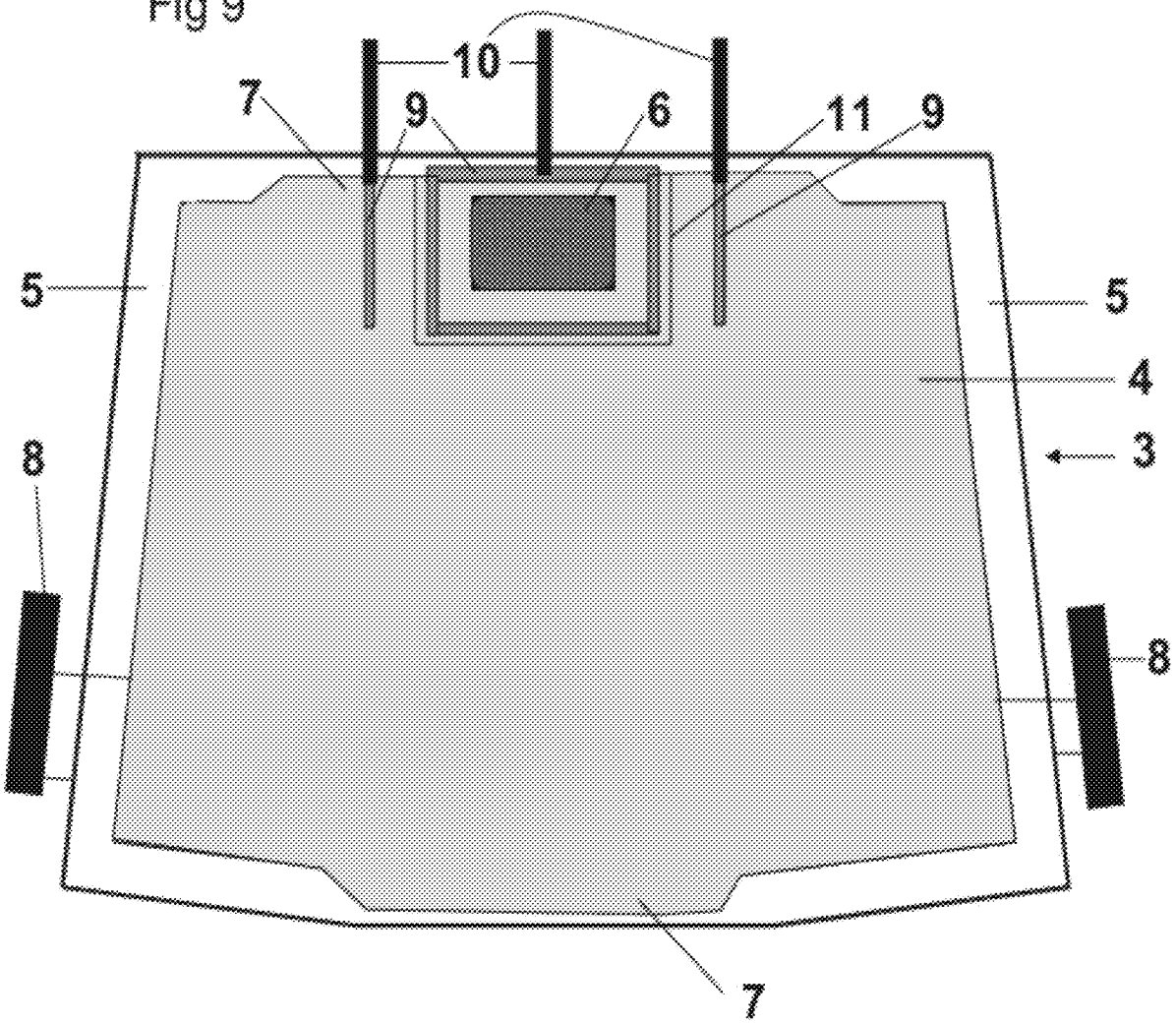
Figure 10:
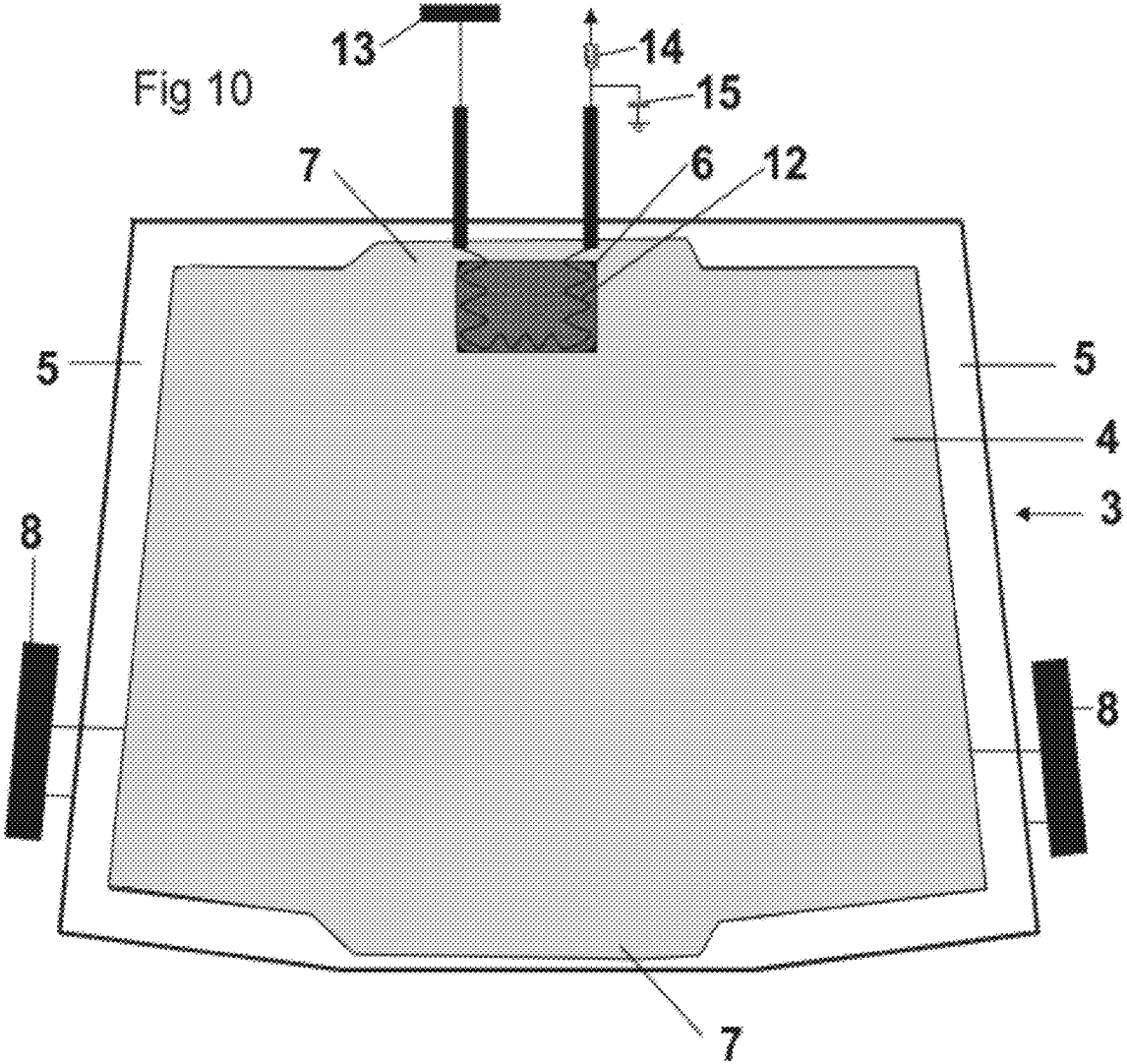

Embodiments of the present invention will now be described herein, by way of example only, with reference to the following figures:

FIG. 1—shows a front view of a vehicle in accordance with the present invention;

FIG. 2—shows a schematic plan view of a glazing in accordance with the present invention;

FIG. 3—shows a schematic plan view of a glazing in accordance with the present invention with silver print in the region arranged to overlap with a metal surround;

FIG. 4—shows a schematic plan view of a glazing in accordance with the present invention with silver print enclosing the device;

FIG. 5—shows a schematic plan view of a glazing in accordance with the present invention with silver print between the device and longitudinal ends of the slot antennas;

FIG. 6—shows a schematic plan view of a glazing in accordance with the present invention with laser lines electrically isolating the device from the slot antennas;

FIG. 7—shows a schematic plan view of a glazing in accordance with the present invention with laser lines electrically isolating the device from the slot antennas and silver print enclosing the device;

FIG. 8—shows a schematic plan view of a glazing in accordance with the present invention with laser lines electrically isolating the device from the slot antennas, and silver print between the laser lines and longitudinal ends of the slot antennas;

FIG. 9—shows a schematic plan view of a glazing in accordance with the present invention with laser lines electrically isolating the device from the slot antennas, silver print between the laser lines and the device enclosing the device, and silver print between the laser lines and longitudinal ends of the slot antennas; and FIG. 10—shows a schematic plan view of a glazing in accordance with the present invention with a heater for the device.

All of the figures are schematic representations and must not be regarded as to scale. They serve to illustrate the principle behind the invention. The skilled person will, of course, for each specific requirement adapt the conductor structure to the actual geometry and dimensions of the glazing and optimise the antenna arrangement in the usual way within the scope of the invention.

FIG. 1 shows a front view of a vehicle, in this case an automobile 1, in accordance with the present invention. Automobile 1 has a metal surround 2 enclosing a glazing 3, which in this embodiment is a windscreen. Glazing 3 has a conductive panel 4, which is a silver coating. The panel 4 is not present along the upper edge of the glazing 3 except for a central portion 4*a*, allowing for the presence of two slot antennas 5. Attached to the inside of the glazing 3 is a camera and toll sensor 6. The positioning of the camera and toll sensor 6 in order that they do not overlap with the slot antennas 5 reduces the EMI that the slot antennas 5 are exposed to.

FIG. 2 shows an embodiment of a glazing 3 in accordance with the invention. The metal surround, usually metal vehicle bodywork, is not shown. The metal surround generally has a polygonal opening. The individual panes are not shown. Rather, only the conductor structures essential for the slot antenna 5 and device 6 functions are shown in the projection on the plane of the outer pane. The conductor structures can be arranged entirely in a single plane or in different planes. Not shown are pane components not or not substantially contributing to the slot antenna 5 and device 6 functions, such as laminating foils, non-conductive coatings such as opaque strips of baked-on enamel applied by the silk-screen method, with which the conductor structures are wholly or partly optically concealed, mounting adhesives, frame components (e.g. sealing profiles) and the like. Some vehicles do not have metal vehicle bodywork that surrounds all edges of the glass. However, sufficient metal may exist in the vehicle bodywork formed from grounded flat, meshed or latticed conductors in the region of the slot antenna(s) 5 and device(s) 6.

Glazing 3 in FIG. 2 has a conductive panel 4, which is a silver coating. The panel 4 is not present around the periphery of the glazing 3, except for central regions 7 at the top and bottom of the glazing 3. This arrangement affords two dielectric slots, allowing for the presence of, in this case, two slot antennas 5. Again, attached to the inside of the glazing 3 is a camera and toll sensor 6. The positioning of the camera and toll sensor 6 in order that they do not overlap with the slot antennas 5 reduces the EMI that the slot antennas 5 are exposed to.

To ensure that the slot antennas 5, explained in greater detail in the following, and their radiating areas function well, it is important that the conductive panel 4 extends so as to be near to the metal surround but does not overlap with it, to form a slot with an appropriate width, according to the desired bandwidth. The conductive panel 4 is needed as a counter surface to the metal surround for all slot antennas 5 of the glazing according to the invention. This means that its distance from the individual slot antennas 5 must not be too great. The same applies to the distance of the slot antennas 5 from the metal surround. The width of the slot antennas 5 should preferably be markedly less than a fifth of the mean wavelength (multiplied by the dielectric shortening factor of glass of about 0.6-0.7 of the relevant frequency range).

As mentioned above, in the embodiment of FIG. 2, the conductive panel 4 is not spaced from the metal surround all the way around the periphery of the panel 4, since in two areas 7 the panel 4 extends far enough to the border of the glazing 3 to enable the panel to overlap with the metal surround, thereby the panel 4 can be HF-coupled to the metal surround and thus regions 7 effectively terminate the slot antennas 5. The invention also includes arrangements with rectangular, L—or other shaped slot antennas 5 where, however, the width of the slot antennas 5 is always clearly less than its length.

The two slot antennas 5 possess dielectric radiating areas surrounded (enclosed) by HF-conductive frames and are each shaped geometrically like a U. The width of the radiating areas of the slot antennas 5 is at any point never less than the minimum of approx. 1 cm required for fault free function as a slot antenna in the VHF range. In the example shown the radiating areas of the two slot antennas 5 are of approximately the same width. However, they could be of different widths, taking into consideration the above mentioned preferred minimum width. At the top the width of the radiating areas is limited by the specified width of the slot antennas 5. The width of the radiating areas of the slot antennas 5 influences the band width of the receivable frequency range. As the width of the slot antenna increases, so does the band width.

The length of the radiating areas of the slot antennas 5 is determined by locations where antenna currents can flow from the panel 4 to the metal surround 2. This current flow may be by capacitive coupling in the regions 7 or by other conductors (not displayed here) that provide DC or low frequency current to heat the coating or heater grid 4. Connecting leads 8 are connected HF-conductively to the panel 4 and the metal surround at points distant from the longitudinal ends of the slot antennas 5. The connecting leads 8 may be connected capacitively or directly e.g. by soldering, friction welding or by means of conductive adhesive.

The panel 4 together with additional shielding provided by the metallic housing of the device 6 serves to shield the slot antennas from EMI. If small holes in the panel 4 are required, for instance to provide a view for IR sensors/cameras, this has been known to cause a shielding problem, but even this EMI is reduced by the arrangement of FIG. 2.

FIG. 3 shows a schematic plan view of a glazing 3 resembling the glazing of FIG. 2 but with a strip of silver print 9 added to the conductive panel 4 in the region 7 arranged to overlap with a metal surround at the top of the glazing. The silver print 9 is grounded, for example to the metal surround, via connector 10. This arrangement further reduces the EMI that the slot antennas 5 experience by improving the overlap between the metal surround and conductive panel 4. The silver print 9 may be attached to the internal surface of the glazing or directly connected to the panel 4, e.g. in a heated windscreen.

FIG. 4 shows an embodiment wherein silver print 9 encloses the device 6. This glazing 3 has the same advantages as the glazing 3 of FIG. 3 but affords further suppression of the EMI. This is achieved by surrounding the device 6 with silver print 9 which provides a pathway for EMI, especially EMI currents, to exit the glazing 3 without affecting the slot antennas 5.

FIG. 5 shows a glazing 3 in accordance with FIG. 2 but with strips of silver print 9 between the device 6 and longitudinal ends of the slot antennas 5. The strips of silver print 9 are grounded via connectors 10. The print 9 serves to guide the interference currents at the longitudinal ends of the slot antennas 5 away from the device 6, further reducing the EMI.

FIG. 6 shows a glazing 3 in accordance with FIG. 2 but with laser lines 11 electrically isolating the device 6 from the slot antennas 5. This arrangement is beneficial because the laser lines 11 separate the region of the panel 4 comprising the device 6 from the longitudinal ends of the slot antennas 5. The laser lines 11 help to "guide" the currents of the slot antennas 5 around the slots 5 and keep the EMI currents near to the device 6.

FIG. 7 shows a glazing 3 with laser lines 11 electrically isolating the device 6 from the slot antennas 5 and silver print 9 enclosing the device 6. This arrangement combines the features of FIGS. 4 and 6. It provides reduced EMI by grounding the EMI from the device 6 with the enclosing silver print 9 and separating the ends of the slot antennas 5 from the device 6 with the laser lines 11.

FIG. 8 shows a glazing 3 with laser lines 11 electrically isolating the device 6 from the slot antennas 5, and silver print 9 between the laser lines 11 and longitudinal ends of the slot antennas 5. This arrangement combines the features of FIGS. 5 and 6. It also provides reduced EMI as print 9 serves to guide the interference currents at the longitudinal ends of the slot antennas 5 away from the device 6, whilst laser lines 11 help to "guide" the currents of the slot antennas 5 around the slots 5 and keep the EMI currents near to the device 6.

FIG. 9 shows a glazing 3 with laser lines 11 electrically isolating the device 6 from the slot antennas 5, silver print 9 between the laser lines 11 and the device 6 enclosing the device 6, and strips of silver print 9 between the laser lines 11 and longitudinal ends of the slot antennas 5. This arrangement combines the features of FIGS. 4, 5 and 6 and provides reduced EMI as print 9 located between the laser lines 11 and longitudinal ends of the slot antennas 5 guides the HF antenna currents away from the device 6. Furthermore, the print 9 located between the laser lines 11 and the device 6 guides the EMI currents of the device 6, whilst the laser lines 11 prevent the HF antenna currents and the EMI device currents from flowing along identical printed routes 9.

FIG. 10 shows a glazing 3 with a heater 12 for the device 6 (a camera). In this case the heater 12 is a silverprint on the inside surface of the glazing 3, but embedded wires can also be used. The heater 12 couples capacitively to the panel 4 and overlaps with the area of device 6, enabling efficient grounding of the EMI from the device 6. Heater 12 is arranged to be grounded to the metal bodywork of a vehicle at ground connection 13. Heater 12 is also connected to an inductor 14, to prevent the entrance of EMI from the car network into the heater circuit, and to a capacitor 15, which will ground the remaining EMI signals from the car network. Such heaters 12 can be used to avoid icing, fogging or misting of the area of the glazing 3 where the device 6 is situated. This arrangement provides another way of effectively grounding the EMI generated by the device 6.

The invention claimed is:

1. A laminated vehicle glazing for fitting within a metal surround, said glazing comprising:

an inner pane, an outer pane, a bonding layer between said inner pane and said outer pane, a conductive panel arranged to define at least one elongated dielectric slot antenna between an edge of the metal surround and an edge of the conductive panel, said at least one slot antenna comprising a high-frequency current-conductive frame bounding an elongated area of the antenna and opposed edge conductors adapted for the connection of connecting leads, and at least one device that can emit electromagnetic radiation, wherein said device occupies an area, wherein the area of the at least one device that can emit electromagnetic radiation and the area of the at least one slot antenna do not overlap in the projection of said areas on the plane of the outer pane.

2. The glazing according to claim 1, wherein the at least one device is located in a region between longitudinal ends of the at least one slot antenna in the projection of said areas on the plane of the outer pane.

3. The glazing according to claim 1, wherein a radiating/receiving area of the at least one device and a radiating/receiving area of the at least one slot antenna do not overlap in the projection of said areas on the plane of the outer pane.

4. The glazing according to claim 1, wherein the conductive panel is arranged to overlap with the metal surround in at least one edge region of the glazing, thereby being high-frequency current coupled to said metal surround at said at least one edge region.

5. The glazing according to claim 4, wherein the at least one device is located in said at least one edge region.

6. The glazing according to claim 1, wherein the glazing further comprises means for separating the electrical current at at least one longitudinal end of said at least one slot antenna from the current induced by said at least one device.

7. The glazing according to claim 6, wherein said means comprises at least one conductive wire and/or at least one conductive print electrically connected or capacitively coupled to the conductive panel.

8. The glazing according to claim 7, wherein said at least one conductive wire and/or at least one conductive print is located at one or more longitudinal end of the at least one slot antenna.

9. The glazing according to claim 8, wherein said wire and/or print extends across a portion of the conductive panel to a ground connection.

10. The glazing according to claim 7, wherein the at least one conductive wire and/or at least one conductive print is located such that said wire and/or print at least partially encloses the at least one device.

11. The glazing according to claim 7, wherein the at least one conductive wire and/or at least one conductive print is capable of emitting heat.

12. The glazing according to claim 6, wherein said means comprises at least one barrier line for electrically isolating regions of the conductive panel.

13. The glazing according to claim 12, wherein said at least one barrier line comprises a gap in the conductive panel.

14. The glazing according to claim 12, wherein the at least one barrier line is straight or angled, undulating, curved, zigzagged, fractal and/or other non-rectilinear barrier lines.

15. The glazing according to claim 12, wherein the at least one barrier line forms a grid of constant or variable raster unit size.

16. The glazing according to claim 12, wherein the at least one barrier line is generated by means of laser technology.

17. The glazing according to claim 1, wherein the at least one device is a camera and/or a sensor.

18. The glazing according to claim 1, wherein the conductive panel comprises an optically transparent solar control coating capable of reducing solar energy transmission in at least one portion of the solar energy spectrum.

19. The glazing according to claim 1, wherein the glazing comprises at least two slot antennas being arranged parallel and adjacent to one another over at least a part of their length.

20. The glazing according to claim 1, wherein the glazing forms part of a diversity system and is connected to a diversity circuit.

21. A vehicle incorporating at least one glazing according to claim 1.

* * * * *